United States Patent [19]

McManus

[11] Patent Number: 4,805,283

[45] **Date of Patent: * Feb. 21, 1989**

[54] METHOD FOR FORMING SLIT FIN COILS

[75] Inventor: John R. McManus, Marcellus, N.Y.

[73] Assignee: Carrier Corporation, Syracuse, N.Y.

[ * ] Notice: The portion of the term of this patent subsequent to Oct. 28, 2003 has been disclaimed.

[21] Appl. No.: 125,920

[22] Filed: Nov. 27, 1987

Related U.S. Application Data

[62] Division of Ser. No. 939,823, Dec. 9, 1986, Pat. No. 4,770,241, which is a division of Ser. No. 695,435, Jan. 10, 1985, Pat. No. 4,682,488.

[51] Int. Cl.[4] ..... B21D 53/02

[52] U.S. Cl. ..... 29/157.3 R; 29/157.3 A; 29/727

[58] Field of Search ..... 29/727, 157.3 R, 157.3 A, 29/157.3 AH; 165/65, 172; 72/387, 381, 383, 388, 384, 212, 213, 214, 215–220

[56] References Cited

U.S. PATENT DOCUMENTS 4,619,024 10/1986 McManus et al. ..... 29/727

4,619,025 10/1986 McManus et al. ..... 29/727

*Primary Examiner*—P. W. Echols

*Assistant Examiner*—Irene Cuda

*Attorney, Agent, or Firm*—David J. Zobkiw

[57] ABSTRACT

A slit fin heat exchanger is formed by wrapping slit fin tubing into a flat coil having two spaced rows of tubing. The flat coil is located on mandrels which are rotatable about spaced parallel axes with the mandrels and axes initially being in the same plane. The mandrels are rotated about their axes in opposite directions which shifts the plane in which the coil is located. The shifting of the plane of the coil moves a portion of a first row of the coil into contact with a planar portion of a platen and the second row of the coil into a nesting relationship with the portion of the first row which is in contact with the planar portion of the platen. Continued rotation of the mandrels causes folding of the portions of the coil which extends the area of nesting. The folding takes place through up to 120° and the ends of the first row of the coil contacts a portion of the platen causing the formation of a knob at the end of each coil.

3 Claims, 8 Drawing Sheets

METHOD FOR FORMING SLIT FIN COILS

This application is a division of application Ser. No. 939,823 filed on Dec. 9, 1986 now U.S. Pat. No. 4,470,291 which is a divisional application of prior application Ser. No. 695,435 filed on Jan. 10, 1985 now U.S. Pat. No. 4,682,488.

BACKGROUND OF THE INVENTION

Spined or slit fins are formed from flat stock with cuts made uniformly along each side and with the central portion left intact. The slit flat stock is then bent into a U-shaped configuration with the central un-cut portion serving as the bight or base. The U-shaped slit stock is spirally wrapped about the tubing and is glued or otherwise suitably secured to the tubing with the base or bight in metal-to-metal contact with the tubing. This results in the tubing being covered with radiating spines or tines to produce slit fin tubing stock suitable for use as heat exchange coils.

Conventionally, the slit fin tubing stock has been wrapped around a forming drum with the wraps in a parallel abutting relation to each other to form a plurality of helically wound circuits which, in turn, make up the coil. Terminal leads are provided at each end of the circuits. The forming drum is then removed. Terminal leads at each end of the circuits of the coil are bent, disposed one inwardly of the other so that they are positioned tangent to the same plane, which is perpendicular to the center longitudinal axis of the coil, and then a portion of each terminal lead is cut off and joined to a header. Due to the fragility of the individual spines or tines, any subsequent forming of the coil has been precluded.

SUMMARY OF THE INVENTION

Slit fin tubing stock is wound about two mandrels respectively attached to two rotating arms of a coil wrapping machine to form a flat coiled, two row, slit fin heat exchanger. The mandrels are spaced to provide enough material to form the desired coil shape and the distance may be variable to accommodate different coils. The flat coiled heat exchanger can be made up of a number of circuits having their ends strapped or otherwise suitably secured to make the flat coil with a pair of leads extending from the coil for each circuit. The flat coil is removed from the coil wrapping machine and placed upon corresponding mandrels of a coil forming machine. This flat coil can then be formed into a wide range of desired coil configurations according to the teachings of the present invention. Specifically, the flat coil coacts with a fixed platen due to the movement of the two arms of the coil forming machine. The two rows of the coil are brought into a nesting contact in their center portion with the fixed platen providing support. Because a considerable number of spines or tines initially contact the platen, their collective resistance to columnar buckling provides enough stiffness to prevent any significant deformation of the tines in the central area. As the arms move, the nexting contact between the two rows proceeds from the central section towards the ends. The nesting contact progresses with the bending of the two rows in accordance with the shape of the platen. As the axes of rotation of the arms are in a different plane than the upper surface of the platen, the arms become effectively shorter relative to the coil as they move from a horizontal position. Because of the nesting action, together with the resistance to columnar buckling, the two rows can be bent by folding through at least 120° without significantly deforming the tines and with no more than a 10–20% reduction in the cross sectional area of the tubes. Since in a simple "L", "U" or "C" bend, the outer rows will be bent at a larger radius than the inner rows the difference in lengths of the two rows of coils is compensated at the ends by forming a knob at the end of each coil.

It is an object of this invention to provide a method and apparatus for making and forming slit fin coils.

It is another object of this invention to form a slit fin coil by folding a flat coil into a desired configuration.

It is a further object of this invention to provide a method and apparatus for forming slit fin coils having multiple bends. These objects, and others as will become apparent hereinafter, are accomplished by the present invention.

Basically, the slit fin tubing stock is wound around two spaced and horizontally extending mandrels of a coil wrapping machine with the slit fin tubing stock being cut to form the required number of circuits. The cut slit fin tubing stock is collectively wound for the required number of turns whereupon the flat coil is removed from the mandrels of the coil wrapping machine and placed on the corresponding mandrels of a coil forming machine. The platen may be in place on the coil wrapping machine or else it is moved into place under the resulting flat coiled, two row, slit fin heat exchanger. The arms carrying the mandrels of the coil forming machine are rotated such that the mandrels are moved through arcs in opposite directions such that the outer ends of the mandrels move downwardly and towards each other. The downward movement of the mandrels initially brings the central portion of the lower rows of coils into contact with the upper planar surface of the underlying platen and brings the tines of the upper rows of coils into nesting contact with the tines of the lower rows of coils with the initial nesting taking place for all portions of the coils overlying the platen. Continued movement of the arms brings the mandrels below the upper surface of the platen and causes the folding of the coils. The nesting contact continues to extend toward the mandrels as the mandrels move through their arcs and cause further forming of the coils. Because they bend through tighter radii, the lower rows of coils would extend further from the bend than the upper rows of coils. However, at the mandrel ends the platen deforms only the lower rows of coils to make a knob which additionally nests the upper and lower coils essentially all the way to the mandrel.

BRIEF DESCRIPTION OF THE DRAWINGS

For a further understanding of the present invention, reference should now be made to the following detailed description thereof taken in conjunction with the accompanying drawings wherein.

DESCRIPTION OF THE PREFERRED EMBODIMENT

Figure 1:
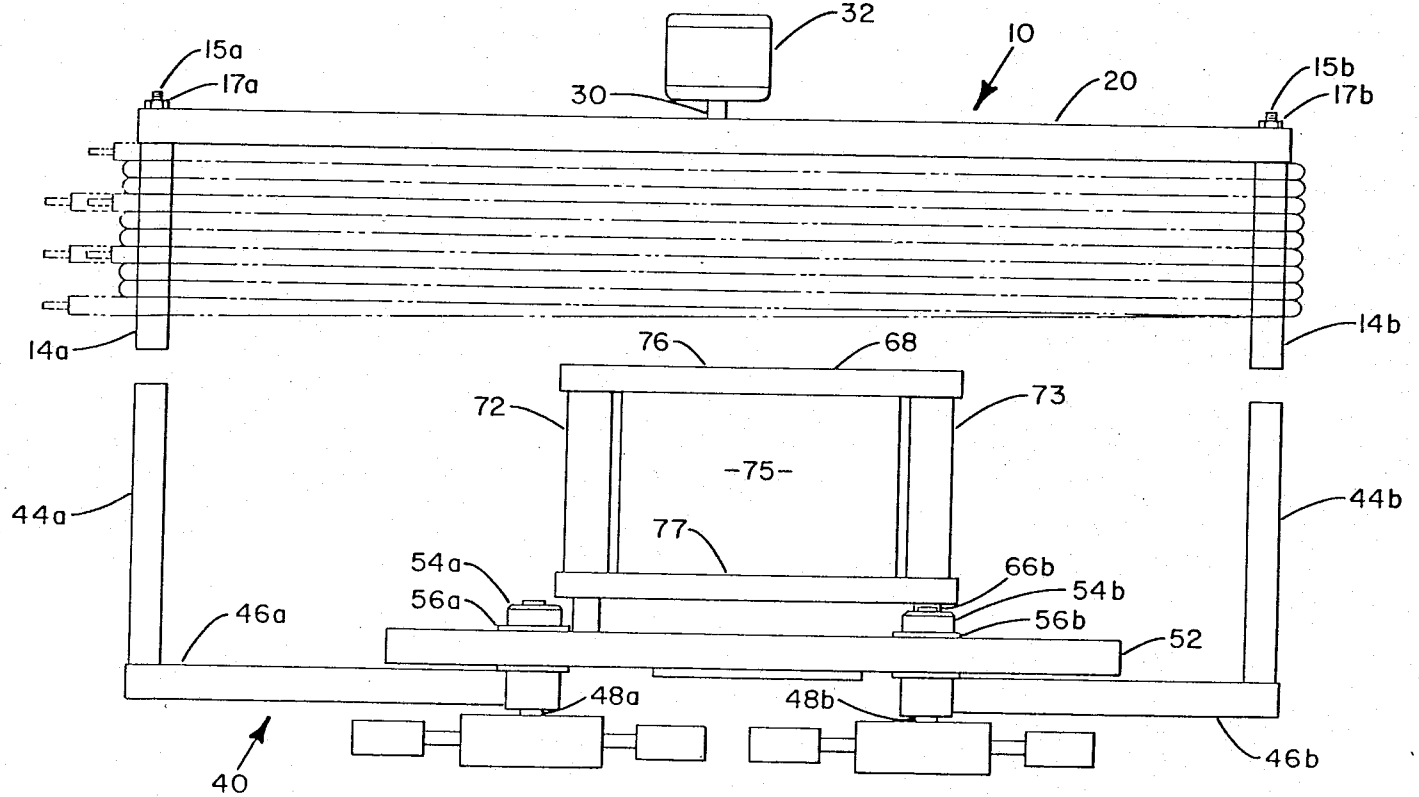
FIG. 1 is a top view of the coil wrapping machine and the coil forming machine showing the coil in phantom on the coil wrapping machine.
Figures 2, 2A:
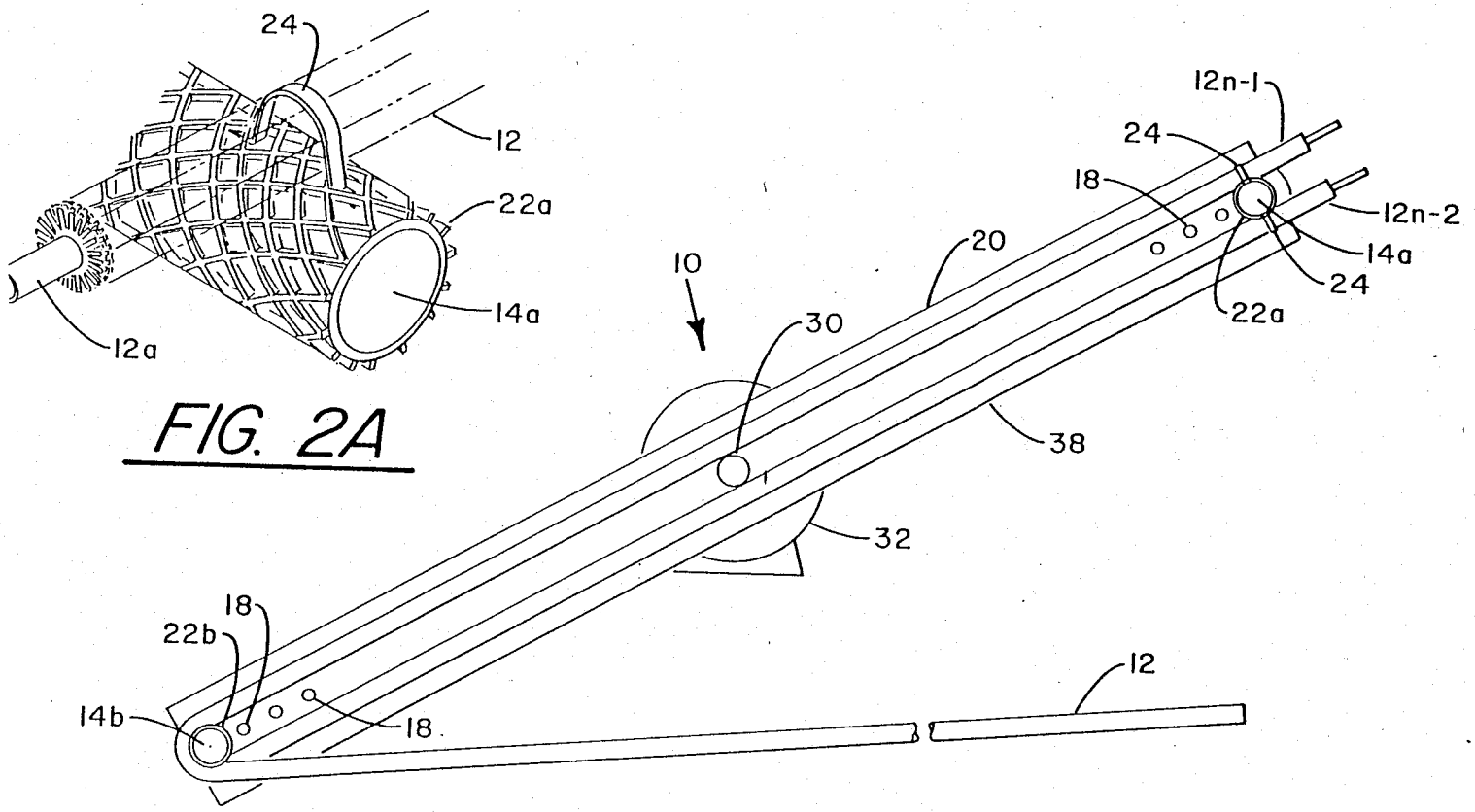
FIG. 2 is a front view of the coil wrapping machine with a multi-circuit coil being wound thereon.
FIG. 2A is a pictorial view of an end of a coil wrap secured in place on the wrapping machine.
Figure 3:
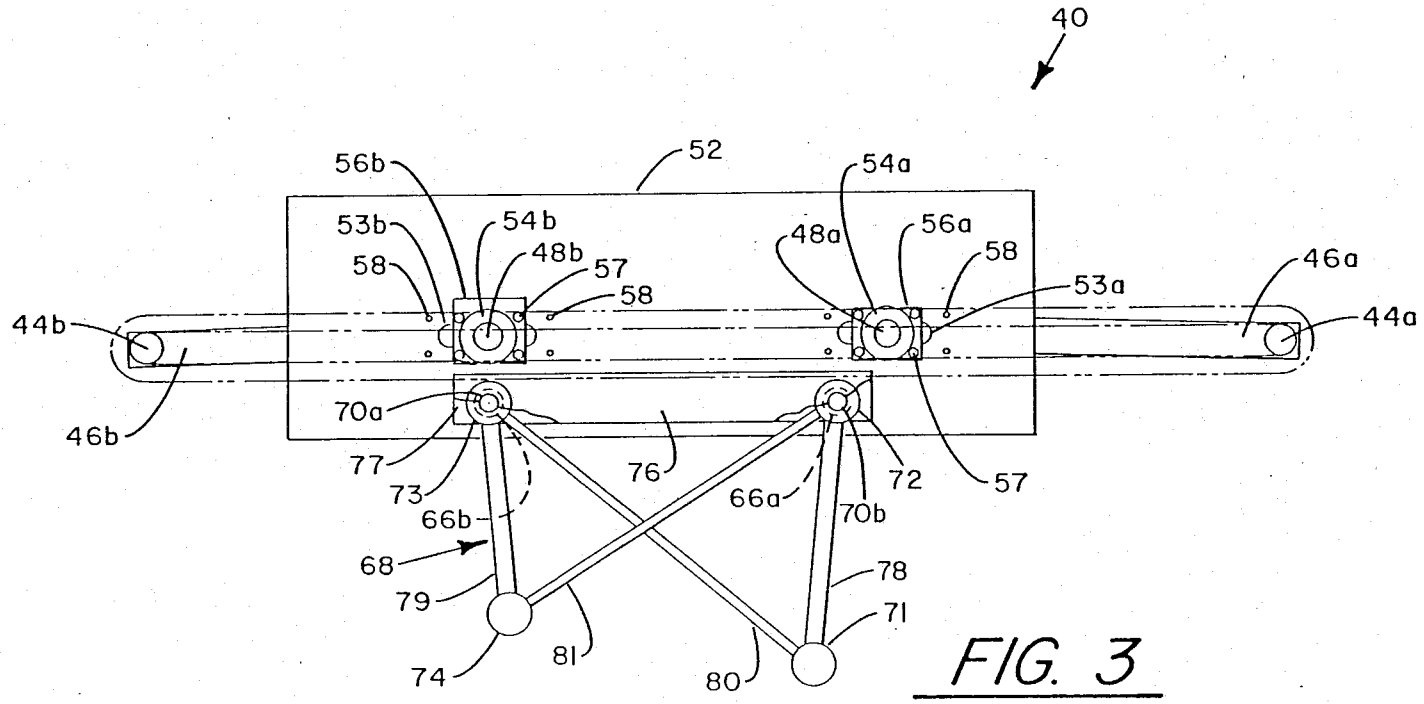
FIG. 3 is a partially cut away front view of the coil forming machine with a coil shown in phantom.
Figure 4:
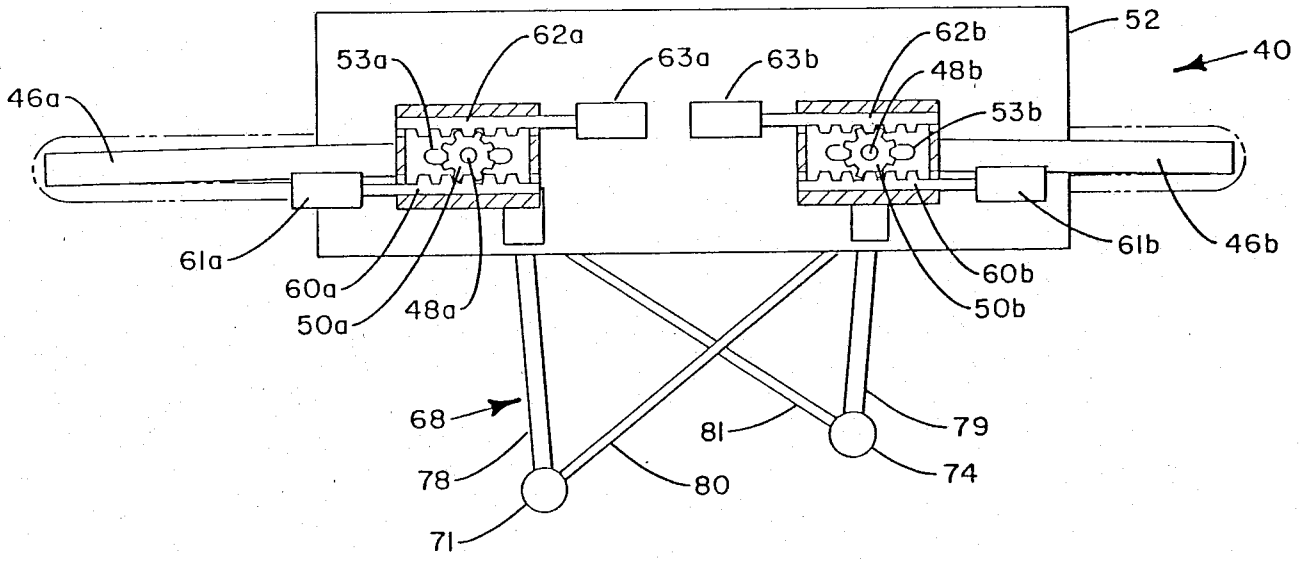
FIG. 4 is a back view of the coil forming machine with a coil shown in phantom.

In FIGS. 1 and 2 the numeral 10 generally designates the coil winding machine or device. In FIGS. 1, 3 and 4 the numeral 40 generally designates the coil forming machine or device. In FIGS. 1–4 the structure for supporting the coil winding and coil forming devices has been omitted to simplify and clarify the drawings. The support structure can be any suitable support structure, as is well known in the art, which will permit movement of the members necessary for the winding and forming operations. During the winding operation, slit fin coil stock 12 is fed from a source thereof, such as a fin winding machine (not illustrated) as the coil support structure of the coil winding device 10 is rotated. The coil stock 12 is wrapped around parallel, spaced mandrels 14*a* and *b* which are suitably adjustably secured to the outer ends of bar or plate 20. For example, the threaded portions 15*a* and *b*, respectively, of mandrels 14*a* and *b* can be placed in suitable bores 18 and held in place by nuts 17*a* and *b* respectively. Shaft 30 is suitably fixedly secured to plate 20 for rotating mandrels 14*a* and *b*, and plate 20 as a unit and for winding coil stock 12 onto mandrels 14*a* and *b* as is best shown in FIG. 2. Shaft 30 effectively divides plate 20 into two arms and is rotated by motor 32 in a conventional fashion.

Mandrels 14*a* and *b* are preferably initially adjustably spaced a predetermined fixed distance apart on bar 20 to obtain the desired coil width. As best shown in FIG. 2A, an end 12*a* of the coil stock is suitably secured to either mandrel 14*a* or *b*. As illustrated, an expanded metal cylinder 22*a* is initially placed over mandrel 14*a* and end 12*a* is secured thereto by a spring clip 24, a wire, twist tie or any other suitable attachment means. An expanded metal cylinder is similarly preferably placed over mandrel 14*b*. Motor 32 is actuated to cause the rotation of shaft 30, mandrels 14*a* and *b*, and plate or bar 20 as a unit which causes the coil stock 12 to be wound about mandrels 14*a* and *b* in a flat two row coil 38. As a plurality of circuits are generally required in the coil 38, each time a sufficient number of turns are made for a circuit, the coil stock 12 is cut with each end 12*a*, 12*b*, . . . 12*n*−1, 12*n* being strapped or otherwise suitably secured, as by spring clips 24, twist ties, etc. in place on mandrel 14*a* or *b* or the expanded metal cylinders 22*a* and *b* placed on mandrels 14*a* or *b*. However, all of the ends 12*a*–12*n* will be on only one of the mandrels 14*a* or *b* since they must be connected to headers. After the desired number of turns and circuits have been made, the flat coil 38 is slid from mandrels 14*a* and *b* of coil winding machine 10 and placed onto the mandrels 44*a* and *b* of coil forming device 40. While mandrels 14*a* and *b* and 44*a* and *b* are shown as being coaxial, this is not necessary and, in addition, the spacing must be great enough to permit removal of the formed coil 138. If expanded metal cylinders such as 22*a* and *b* are placed on mandrels 14*a* and *b*, removal of the coil 38 is facilitated as the contact between the tines and the mandrels is greatly reduced. This results in a reduced holding force relative to the mandrels and reduced flexural distortion of the tines upon removal of the coil.

As is best shown in FIGS. 3 and 4, the mandrels 44*a* and *b* are fixed at or near the outer ends of arms 46*a* and *b*, respectively, which are fixedly secured to and pivoted about axles 48*a* and *b*, repectively. Axle 48*a* has a gear 50*a* fixedly secured to one end while the other end extends through slots 53*a* in frame 52 into bearing block 54*a*. Similarly, axle 48*b* has a gear 50*b* fixedly secured to one end while the other end extends through slot 53*b* in frame 52 into bearing block 54*b*. Bearing blocks 54*a* and *b* are supported on plates 56*a* and *b* which are adjustably movable relative to slots 53*a* and *b*, respectively, for adjusting the spacing and locations of mandrels 44*a* and *b*, respectively. Plates 56*a* and *b* are fixedly positioned at the selected position by bolts 57 which extend through plates 56*a* or *b* and are threaded into threaded bores 58 in frame 52. Referring now to FIG. 4, gear 50*a* is in meshing engagement with racks 60*a* and 62*a* which are adjustably positioned by hydraulic cylinders 61*a* and 63*a*, respectively. Gear 50*b* is in meshing engagement with racks 60*b* and 62*b* which are adjustably positioned by hydraulic cylinders 61*b* and 63*b*, respectively. The hydraulic cylinders 61*a* and *b* and 63*a* and *b* are conventional hydraulic cylinders which are moved in response to pressurized hydraulic fluid supplied by a pump (not illustrated) and are controlled in any suitable conventional manner. The racks 60*a* and *b* and 62*a* and *b* are guidably secured so that only reciprocating movement under the control of hydraulic cylinders 61*a* and *b* and 63*a* and *b* and in engagement with one of gears 50*a* and *b* is possible. This arrangement affords positive individual bidirectional control over the rotation of arms 46*a* and *b*.

Extending outwardly from frame 52, parallel to and in the direction of mandrels 44*a* and *b*, are supports 66*a* and *b* which are received in corresponding openings 70*a* and *b* in platen 68 when platen 68 is positioned on frame 52 of coil forming device 40. The platen 68 is made up of a number of tubular or cylindrical members 71–74 which, when platen 68 is in place on frame 52, are parallel to mandrels 44*a* and *b*. Cylindrical members 71–74 and planar member 75 are the only portions of platen 68 to contact the coil 38 during the forming operation and the upper surface of planar member 75 is in a plane essentially tangential with the cylindrical members 72 and 73. Cylindrical members 72 and 73 and planar member 75 are located between plate members 76 and 77. Cylindrical member 71 is connected to cylindrical member 72 via support member 78 and cylindrical member 74 is connected to cylindrical member 73 via support member 79. Braces 80 and 81 serve to support the cylindrical members against the forming forces. Cylindrical members 73 and 73 and planar member 75 must, however, be located in a plane spaced from the plane containing mandrels 44*a* and *b* and axles 48*a* and *b* to provide a clearance for placing the coil 38 or platen 68 in place for the forming operation.

In operation, the coil winding machine 10 and the coil forming machine 40 can be proximately or remotely spaced or can be relatively positioned as illustrated in FIG. 1. They must, however, be sufficiently spaced to remove the formed coil from coil forming machine 40.

This permits the flat two row coil 38 to be wound on coil winding machine 1 and then slid or otherwise moved directly onto the mandrels 44*a* and *b* of coil forming machine 40 where flat two row coil 38 is formed into coil 138 having the desired configuration.

Referring now to FIGS. 1 and 2, mandrels 14*a* and *b* are adjustably positioned so as to be properly spaced to form a coil 38 to the proper width to form the desired coil. Mandrels 14*a* and *b* are positioned by placing threaded portions 15*a* and *b* through appropriate bores 18 in plate 20 then threading nuts 17*a* and *b* thereon. Mandrels 44*a* and *b* and corresponding arms 46*a* and *b*, are adjusted as units. Specifically, the bolts 57 securing plates 56*a* and *b* in place would be removed to permit axles 48*a* and *b* to be repositioned within slots 53*a* and *b*, respectively, in frame 52. Since gears 50*a* and *b* are fixed to axles 48*a* and *b*, respectively, it is necesary to either permit sliding movemen of the gear and rack assemblies without rotation of the gears 50*a* and *b* or else the gears must be rotated to place the arms 46*a* and *b* in their proper orientation. When the axles 48*a* and *b* are repositioned in their desired locations, the plates 56*a* and *b* are secured in place by threading bolts 57 into appropriate threaded bores 58. The separation of mandrels 44*a* and *b* would be the same as the separation of mandrels 14*a* and *b*. An end, 12*a*, of coil stock 12 is secured in place on either mandrel 14*a* or *b* or, the expanded metal cylinders 22*a* and *b* placed thereon by a spring clip 24 or any other suitable means for holding end 12*a* in place. Motor 32 is then caused to rotate shaft 30, plate 20 and mandrels 14*a* and *b* as a unit which causes coil stock 12 to be wrapped about mandrels 14a and *b* in a flat two row coil. When the desired number of turns have been made to form a circuit, the coil stock 12 is cut and the resultant ends 12*b* and 12*c* are each secured in place on the same mandrel end as 12*a*. Motor 32 is then again caused to rotate shaft 30, plate 20 and mandrels 14*a* and *b* as a unit until the desired number of turns are made to form a second circuit. The coil stock is cut and the resultant ends are secured in place on the appropriate mandrel. This procedure continues until the desired number of circuits have been made. The resultant flat two row coil 38 is then removed from coil winding machine 10. Subsequently, coil 38 is slid onto the mandrels 44*a* and *b* of coil forming machine 40. As the initial, unformed, position of coil 38 should be spaced from the platen 68 to avoid damaging the tines of the tubing when the coil 38 is set in place, platen 68 is normally located in place on frame 52 of coil forming machine 40 when coil 38 is placed on mandrels 44*a* and *b* but in a different plane so as to provide a clearance. The platen 68 is secured in place on frame 52 by supports 66*a* and *b* which are received in corresponding openings 70*a* and *b* in platen 68.

As best shown in FIG. 3, mandrels 44*a* and b, and axles 48*a* and *b* which are received in bearing blocks 54*a* and *b* respectively, are in the same plane prior to the forming of the coil. The upper portion of platen 68 is in a plane below that containing mandrels 44*a* and *b* axles 48*a* and *b* and is located generally coextensively with axles 48*a* and *b*. Specifically, tubular or cylindrical members 72 and 73 are generally spaced the same distances as axles 48*a* and *b* to promote nesting between the two rows 38*a* and *b* of the coil 38 and because their relative positions are factors in determining the length of the arms of the U or C-shaped coil being formed. As viewed in FIG. 3, arm 46*a* turns clockwise and arm 46*b* turns counterclockwise in forming coil 38. Because axles 48*a* and *b*, mandrels 44*a* and *b* and the coil 38 are all initially above platen 68 arms 46*a* and *b* must be rotated to lower the coil 38 until row 38*a* is in contact with platen 68. Continued rotation of arms 46*a* and *b* brings the center portion of rows 38*a* and *b* coil 38 into nesting contact and starts forming coil 38 by bending the tubing. The movement of arms 46*a* and *b* is controlled by gears 50*a* and *b*, respectively. Gear 50*a* is, in turn, controlled by the racks 60*a* and 62*a* through hydraulic cylinders 61*a* and 63*a*, respectively. Similarly, gear 50*b* is, in turn, controlled by racks 60*b* and 62*b* through hydraulic cylinders 61*b* and 63*b*, respectively. The use of hydraulic cylinders to position members is well known in the art and takes place in conventional fashion in the present invention so that further explanation is unnecesary.

Figure 5:
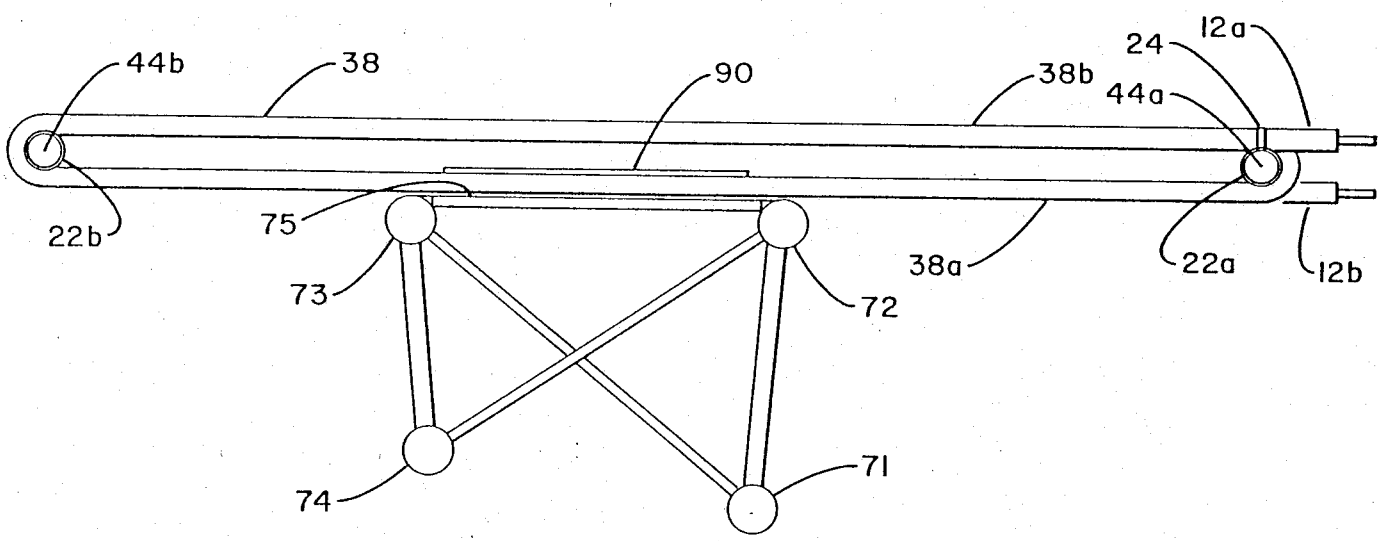
FIG. 5 is a view corresponding to FIG. 3 but only showing the coil and structure of the coil forming machine and platen which contacts the coil during forming.
Figure 6A:
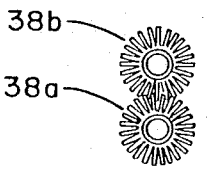
FIG. 6A is a sectional view showing the nesting of he coils.
Figure 6:
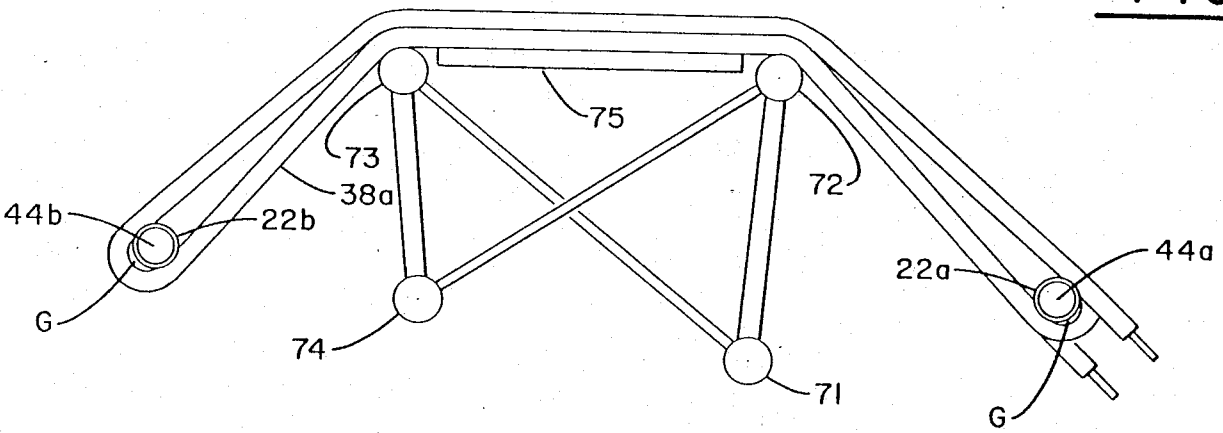
FIG. 6 is a view corresponding to FIG. 5 but with the mandrels moved to start forming the coil.
Figure 8:
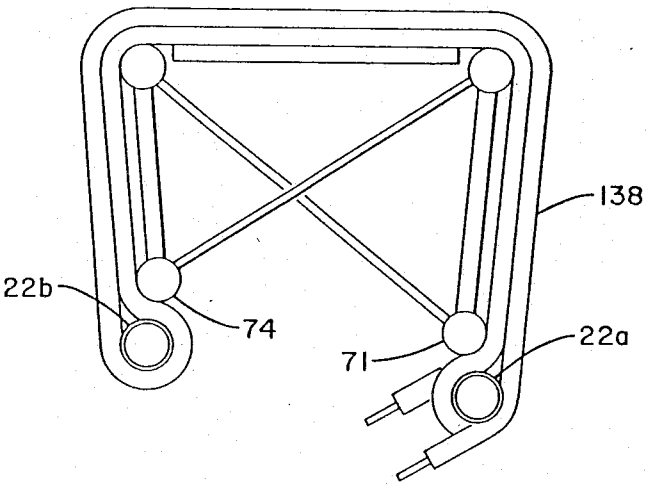
FIG. 8 is a view corresponding to FIG. 7 but showing the final forming for a "C" or "U" coil.

The forming of the coil 38 into coil 138 will now be described in terms of just the coil 38 and the structure in contact with the coil during the forming operation. FIG. 5 which corresponds to a simplified version of FIG. 3 illustrates the coil 38 in place on mandrels 44*a* and *b* prior to any forming action. A piece of expanded metal 90 may be placed between the rows 38*a* and *b* of coil 38. In FIG. 6, the rotation of arms 46*a* and *b* has lowered the spaced rows 38*a* and *b* of the coil such that the bottom row 38*a* is in contact with the tubular members 72 and 73 and planar member 75 of the platen 68 and the central portion of the rows 38*a* and *b* have been brought into nesting contact with the expanded metal 90 and each other to effectively lock the two rows together as is best shows in FIG. 6A. The portions of the coil 38 extending past tubular members 72 and 73 have started to be bent downward. The nesting action of the spines affords a stiffening action which resists lateral movement of the spines or tines and holds them such that columnar buckling is the deforming force and the resistance of the spines is greatest with respect to columnar buckling. It will also be noted that mandrels 44*a* and *b* have started to move closer together and that a gap, G, is starting to form between each of the mandrels 44*a* and *b* and the ends of the coil 38.

Figure 7:
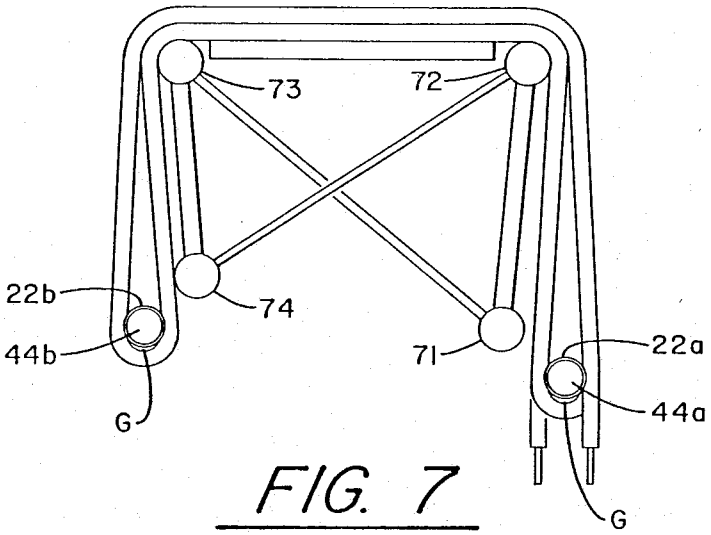
FIG. 7 is a view corresponding to FIG. 6 but showing further forming.

In FIG. 7, the nesting contact between the spaced coils has advanced further toward mandrels 44*a* and *b* locking more of the rows 38*a* and *b* together. Because mandrels 44*a* and *b* are rotating in arcs with axles 48*a* and *b* as their centers, while row 38*a* is being formed about tubular members 72 and 73 and row 38*b* is being formed about the resulting bends in rows 38*a*, the length of arms 46*a* and *b* is effectively reduced thereby effectively bringing the mandrels closer together due to the shifting of the plane of the coil 38 from the FIG. 5 position, and enlarging gaps G. The effective shortening of the arms 46*a* and *b* due to the shifting of the plane of the coil 38 allows the tubing to be formed without being subjected to tension from the mandrels 46*a* and *b* and the rows 38*a* and *b* are in a nested relationship at the bend which permits row 38*a* of a ⅜ inch diameter tube to be bent on a one inch radius with a flattening or cross-sectional area reduction of only about 10%. It should be noted that in contacting tubular members 72 and 73 on the inside of the bend, the tines of row 38*a* are moved closer together to have greater resistance to lateral movement and, therefore, greater resistance to columnar buckling.

Since rows 38*a* and *b* start out at the same length, the longer distance taken by row 38*b* in bending around tubular members 72 and 73 is compensated for by placing a knob at each end of the coil as best shown in FIG.

Figure 9:
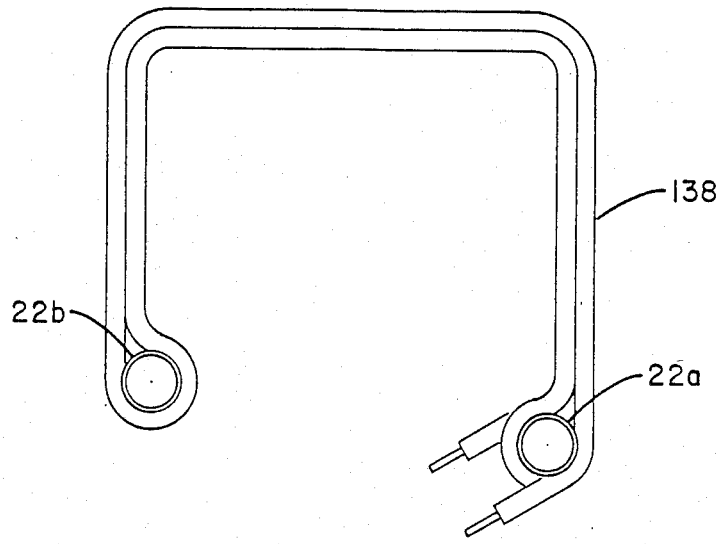
FIG. 9 is an end view of the coil of FIG. 8.

8. Tubular members 71 and 74 contact the corresponding portions of row 38*a* to complete the nesting action and to form a knob at each mandrel and thereby compensate for the different lengths of the bends of the rows about tubular members 72 and 73 and closes gaps G. The resultant formed coil 138 has a degree of resilience and so bounces back from the most extreme or closed position taken during the forming action which facilitates removal of the coil 138 from the coil forming machine 40. The formed coil 138 is illustrated in FIG. 9. The ends 12*a–n* would then be attached to headers in a conventional manner to complete the coil. If the piece of expanded metal 90 was placed between the rows 38*a* and *b* as illustrated in FIG. 5, the resulting locking action due to the nesting action between rows 38*a* and *b* and the piece of expanded metal 90 would provide sufficient rigidity to the coil 138 so that tube supports are not required to support the coil.

In the practice of the present invention, the coil stock is aluminum tubing with aluminum slit fins spirally wrapped thereon. The expanded metal cylinders 22*a* and *b* and plate 90 would be of aluminum. In each case, the expanded metal should be unflattened.

Although the present invention has been specifically described and illustrated, other changes will occur to those skilled in the art. For example, although the coil winding and coil forming machines have been described as having mandrels extending horizontally, they could be vertically disposed without changing the principles of the present invention. Also, the wrapping and forming can take place on the same apparatus. It is, therefore, intended that the scope of the present invention is to be limited only by the scope of the appended claims.

What is claimed is:

1. A method of forming a slit fin heat exchanger comprising the steps of:

wrapping slit fin tubing about a pair of spaced parallel mandrels to form a flat coil having two spaced rows;

with the flat coil in place on a pair of spaced parallel mandrels which are rotatable about spaced axes which are initially parallel to and in the same plane as the mandrels on which the coil is in place, rotating the mandrels on which the coil is placed in opposite directions, thereby, shifting the plane in which the coils and the mandrels are located;

initially contacting a planar surface of a platen with a portion of a first one of the rows of the coil;

with the first one of the rows of the coil contacting the planar surface of the platen shifting the second one of the rows of the coil into contact with the portion of the first one of the rows overlying the platen to cause nesting of the first and second rows of the coil;

folding the portions of the coil extending past the platen about curved portions of the platen and, thereby, extending the portions of the first and second rows which are nested; and contacting additional curved portion of the platen with the first one of the rows of the coil to form a knob at each end of the coil at the mandrels to extend the portions of the first and second rows which are nested to essentially the ends of the coil.

2. The method of claim 1 further including the step of adjusting the spacing of the mandrels.

3. The method of claim 1 wherein the step of folding takes place through at least 60 degrees.

* * * * *